US010907819B1

(12) United States Patent
He

(10) Patent No.: US 10,907,819 B1
(45) Date of Patent: Feb. 2, 2021

(54) FOUNTAIN LIGHT

(71) Applicant: Fujian Quanzhou Fanta Crafts Co., Ltd., Fujian (CN)

(72) Inventor: Ke He, Quanzhou (CN)

(73) Assignee: Fujian Quanzhou Fanta Crafts Co., Ltd., Fujian (CN)

( * ) Notice: Subject to any disclaimer, the term of this patent is extended or adjusted under 35 U.S.C. 154(b) by 0 days.

(21) Appl. No.: 16/746,994

(22) Filed: Jan. 20, 2020

(30) Foreign Application Priority Data

Nov. 11, 2019 (CN) ..... 2019 2 1932563 U

(51) Int. Cl.

| | |
|---|---|
| ***F21V 33/00*** | (2006.01) |
| ***F21V 23/02*** | (2006.01) |
| ***F21V 3/02*** | (2006.01) |
| ***B05B 17/08*** | (2006.01) |
| ***F21V 31/00*** | (2006.01) |
| ***F21S 10/00*** | (2006.01) |
| ***F21W 121/02*** | (2006.01) |

(52) U.S. Cl.
CPC ..... *F21V 33/006* (2013.01); *B05B 17/08* (2013.01); *F21S 10/002* (2013.01); *F21V 3/02* (2013.01); *F21V 23/023* (2013.01); *F21V 31/005* (2013.01); *F21W 2121/02* (2013.01)

(58) Field of Classification Search
CPC ..... F21S 10/002; B05B 17/08
See application file for complete search history.

(56) References Cited

U.S. PATENT DOCUMENTS

| | | | | |
|---|---|---|---|---|
| 2013/0223043 | A1* | 8/2013 | Ray | F21V 33/00 362/96 |
| 2015/0276204 | A1* | 10/2015 | Ray | F21S 6/001 239/20 |
| 2016/0263613 | A1* | 9/2016 | Lin | F21V 33/00 |
| 2016/0298815 | A1* | 10/2016 | Lai | F21S 10/04 |
| 2017/0128973 | A1* | 5/2017 | Jih | B05B 17/08 |
| 2017/0326574 | A1* | 11/2017 | Ding | F21S 10/043 |
| 2017/0363260 | A1* | 12/2017 | Li | F21V 23/04 |
| 2018/0283631 | A1* | 10/2018 | Lian | H05B 47/155 |
| 2019/0338901 | A1* | 11/2019 | Ray | F21S 6/001 |

FOREIGN PATENT DOCUMENTS

| | | |
|---|---|---|
| CN | 204005531 | 12/2014 |

* cited by examiner

*Primary Examiner* — Alexander K Garlen
(74) *Attorney, Agent, or Firm* — JCIP Global Inc.

(57) ABSTRACT

The invention relates to a fountain light comprising a light body. The light body is provided therein with an isolation plate dividing an inner chamber of the light body into a water storage camber and a power supply chamber, which are vertically arranged one above the other. The concaved part of the decorative cover has a hollowed-out pattern. The lighting fountain can be integrated into a small sized lamp, which has the effect that it can be flexibly transferred to various sites where the available space is limited.

10 Claims, 10 Drawing Sheets

A

FOUNTAIN LIGHT

CROSS-REFERENCE TO RELATED APPLICATION

This application claims the priority benefit of China application No. 201921932563.9, filed on Nov. 11, 2019. The entirety of the above-mentioned patent application is hereby incorporated by reference herein and made a part of this specification.

TECHNICAL FIELD

The present invention relates to a technical field of lamp, in particular to a fountain light.

BACKGROUND ART

A lighting fountain is an assembly for spraying water or other liquid under pressure through sprinkler to form specific patterns, which has the effect of decontaminating the air and beautifying the environment. The fountain lights are commonly used in a lighting fountain to illuminate the fountain. There are two kinds of conventional fountain light, one of which is installed under water in the fountain pool, and the other of which is mounted directly on the ground of the square. For example, the Chinese patent NO. "CN204005531U" discloses an LED fountain light. In this fountain light, a passage for passing the fountain water therethrough is arranged on the center axis of the fountain light housing, and the water is sprayed out from nozzles.

The above fountain lights are widely used in various public places, The fountain lights must cooperate with the fountain system in site in order to achieve the effect of lighting fountain, but the fountain system itself is not easy to transfer and requires a certain degree of accommodation space, which results in that the fountain system cannot be used in household application or a party without large square.

SUMMARY OF THE INVENTION

The present invention aims to provide a fountain light, which has the effect that it can be flexibly transferred to various sites where the available space is limited.

The above objective of the invention is implemented through the technical solutions as follows.

A fountain light comprises a light body. The light body is provided therein with an isolation plate dividing an inner chamber of the light body into a water storage camber and a power supply chamber, which are vertically arranged one above the other. The water storage chamber is provided with a pump and a water-passing bracket at the bottom thereof. The top of the water storage chamber is provided with a light hood connected to the water-passing bracket. The light hood is arranged to be spaced apart from the inner wall of the water storage chamber. The light hood is provided with a water outlet hole. The water-passing bracket is provided with a water passage communicated with the water outlet of the pump and the water outlet hole. A first light source is provided between the light hood and the pump. The power supply chamber accommodates a power supply that supplies power to the first light source and the pump. A decorative cover is stacked on the top of the light body. The central part of the decorative cover is concaved and accommodated in the water storage chamber. The concaved part of the decorative cover has a hollowed-out pattern.

In the above technical solution, the whole body of the fountain light is a small sized container. The upper water storage chamber accommodates water and related members of the fountain. The lower power supply chamber provides a power source. In use, first of all, a quantity of water is added into the water storage chamber; then, the water in the water storage chamber is drawn into the interior of the pump by the pump through the water inlet of pump, is sprayed out sequently through the water outlet and the water outlet hole, and is broken into pieces by the hollowed out pattern when passing through the decorative cover, such that the fountain is formed when the water column reaches a position above the decorative cover. At this time, the light hood can provide a degree of water-shielding, such that the light emitted from the first light source and the water column together are projected out of the decorative cover to collectively form a lighting fountain. The water falls back to the concaved part of the decorative cover after being sprayed out, in order to eliminate spillage, and returns to the water storage chamber through the hollowed-out holes without sprayed water in the decorative cover. The water in the water storage chamber flows back to the water inlet area of the pump through the gap between the light hood and the inner wall of the water storage chamber, so as to complete the cycle of the fountain water. Therefore, the lighting fountain can be integrated into a small-sized lamp, which has the effect that it is portable, and can be flexibly transferred to various sites where the available space is limited.

Further, the light hood comprises a light-collecting hood and a light-shielding hood. The light-collecting hood is provided with a spherical surface at the bottom wall thereof. The upper part of the light-collecting hood is snapped into the light-shielding hood.

In the above technical solution, the spherical surface and the light-collecting hood can focus the light into the water column to be sprayed out. The light-shielding hood can shield the superfluous stray light, such that the light at the opening of the water storage chamber is entirely concentrated in the sprayed fountain water, thereby obtaining a better lighting effect.

Further, the light hood is provided with at least two water outlet holes. The water-passing bracket comprises a main body, a shunt disc and nozzles, which are sequentially interconnected from below to above. The nozzle is arranged to communicate with the water outlet hole, and the number of the nozzles corresponds to the number of the water outlet holes. The water-passing passage comprises a main passage, shunt passages and nozzle passages, which are arranged in the main body, the shunt disc and nozzles respectively. The number of the shunt passages coincides with the number of the nozzle passages. The shunt passages communicate with the main passage.

In the above technical solution, after shunting by the shunt disc, the water sprayed by the pump is finally sprayed out by the nozzles. The nozzles are disposed at a plurality of locations according to the distribution of the water outlet holes, such that the fountain is not limited to the middle part or some other location but a plurality of collaborative locations, thereby obtaining a better effect of fountain. Since the light hood has the effect of light shielding, the light emitted from the first source is projected following a plurality of water column respectively, thereby forming the fountain with a plurality of sprayed water columns.

Further, the power supply comprises a battery compartment, a compartment cover and batteries. The compartment cover is detachably connected to the battery compartment. The battery compartment contains batteries therein. Each of the opposing surfaces of the battery compartment and the compartment cover is provided with anode patches connected to the positive electrode of the battery and cathode patches connected to the negative electrode of the battery. The cathode patches and the anode patches in the battery compartment are each provided with a conductive spring. The conductive spring of the anode patch is shorter than the conductive spring of the cathode patch. A telescopic conductive pin, which butts against the single anode patch of the box cap, is arranged to penetrate the battery compartment.

In the above technical solution, during normal use, the compartment cover is arranged below the batteries. The anode patches above the batteries and the telescopic conductive pin above the anode patches of the compartment cover are arranged to be elastic, so as to always provide elastic pre-stressing and an amount of elastic deformation, thereby effectively avoiding an open circuit when the fountain light collides with the desktop or other objects. Especially when the fountain light has timing function, the problems including restarting and the like can be effectively avoided by offering stable and continuous power.

Further, the light hood is provided with a supporting tube at the convex part of the bottom thereof. The shunt disc is provided with a supporting base at the convex part of the top thereof for mounting the supporting tube. An adjustment cap is arranged at the junction of the main passage and the shunt passage. An adaptor chamber communicated with the main passage is arranged at bottom of the adjustment cap. The sidewall of the adaptor chamber has at least a set of through apertures therein to communicate with the shunt passages. The top of the adjustment cap has an adjustment rod fixed thereto, which extends through the shunt disc, the inner cavity of the supporting tube and the light hood. The top of the adjustment rod has a knob fixed thereto.

In the above technical solution, the knob is rotated to cause the rotation of the adjustment cap through the adjustment rod. In this way, the opening size of the through apertures in the adjustment cap and the through-flow opening between the shunt passages can be adjusted so as to control the size or height of the sprayed water column. Furthermore, when multiple set of through apertures are provided, the number of through apertures can be adjusted to determine the number of the shunt passages to be communicated with. Thus, the effect of the fountain can be simply adjusted according to actual requirement. The light hood can be connected to the top of the water-passing bracket more stably via the central positioning of the adjustment rod in conjunction with the vertical tension provided by the knob and the adjustment cap.

Further, the inner wall of the water storage wall has an increasing thickness from the opening to the bottom. The water storage chamber is provided with a water-shielding plate arranged below the light hood. The water-shielding plate forms an interference fit with or is glued to the inner wall of the water storage chamber. The water-shielding plate is downwardly recessed around the central part as a center to form a cone. The central part thereof is arranged to be spaced art from the outer wall of the water-passing bracket to form at least a shutoff groove on the conical surface of the water-shielding plate.

In the above technical solution, during normal use, the water flowing down from the light hood is guided by the conical structure of the water-shielding plate. In this process, part of the impurities such as dust contained in the water are trapped by the shutoff grove so as to protect the pump. In addition, since the battery compartment is at the bottom, accidental flip may occur. When a user accidentally flips it, the water-shielding plate may serve as a water shield to prevent water from inadvertently flowing out.

Further, the light body is a hollow cylinder, comprising a translucent inner cylinder and a transparent outer cylinder. A flange is arranged at the upper end of the inner cylinder, which is overlapped on the end face of the outer cylinder. A first seal ring is arranged between the upper end of the inner cylinder and the upper end of the outer cylinder. A lower end cap covering the power supply is lapped on the lower end face of the outer cylinder. A second seal ring, which fits against the inner wall of the outer cylinder, is arranged on the lower end cap.

In the above technical solution, the light becomes more gentle after going through the inner cylinder. The surface of the transparent outer cylinder can be covered with or designed to have various patterns, therefore the light emerging from the pattern illuminates the pattern clearly, thereby obtaining better decoration effect.

Further, the first seal ring has the same structure as the second seal ring, which comprises a seal ring body, a horizontal part, a connection part, and a vertical part. The inner wall of the seal ring body abuts against the outer wall of the inner cylinder or the outer wall of the lower end cap. The horizontal part extends horizontally from a start point, i.e. the one end of the seal ring body. The connection part extends horizontally from the middle of the side wall of the seal ring body. The vertical part extends vertically from a start point, i.e., the horizontal end of the connection part towards the horizontal part, and the end of the vertical part is spaced apart from the horizontal part. The outer wall of the vertical part and horizontal end of the horizontal part abut against the inner wall of the outer cylinder. The seal ring body, the horizontal part, the connection part and the vertical part together form a semi-closed glue chamber, the opening of which faces the inner wall of the outer cylinder.

In the above technical solution, before the seal ring is mounted, the glue can be firstly applied to the real ring. When the seal ring is mounted, under the pressure of the inner and outer cylinders and the lower end cap, the main deformation of the connection part is produced, while the vertical part creates friction with the inner wall of the outer cylinder and temporarily engages with the horizontal part to close the glue chamber so as to reduce leakage of glue. After it is in position, the glue can be secondly applied to the glue chamber via syringe, etc., such that the connection part restores from the deformation. In addition, due to the orientation of the vertical part, it is not easy to expand after restoration. At this time, the glue and the inner wall of the outer cylinder are a good fit, thereby completing the sealing.

Further, the water storage chamber is provided with a filter plate at the middle. The water-passing bracket is arranged to penetrate the center of the filter plate. The filter plate is provided a plurality of filtering openings surrounding the water-passing bracket. The filtering opening comprises a water inlet groove arranged in the upper surface of the filter plate and a water outlet groove in the lower surface of the filter plate. The water inlet groove is offset horizontally relative to and communicated with the water outlet groove. The bottom of the water inlet groove is inclined with respect to the upper surface of the filter plate. One end of the bottom of the water inlet groove adjacent to the water outlet groove is higher than the other end remote from water outlet groove.

In the above technical solution, the impurities contained in the water can be trapped by the filter alone or cooperated with the water-shielding plate. The water inlet groove and the water outlet groove form a Z shaped water passage. The impurities contained in the water will be trapped at the corner position of the water inlet groove when passing through, so as to protect the pump.

Further, the power supply chamber is provided with a control chip therein. The control chip is electrically connected to the power supply. The control chip controls the pump, the first light source, and a second light source arranged in the power supply chamber. The control chip is wirelessly connected to a controller.

In the above technical solution, the second light source is located below the fountain, so as to enhance a rendering effect of the lighting fountain from the base layer and provide illumination effect. Furthermore, the control chip and the controller can collectively realize remote control.

In summary, the beneficial effects of the present invention are as follow.

1. The whole body of the fountain light is a small sized container. The upper water storage chamber accommodates water and related members of the fountain. The lower power supply chamber provides a power source for spraying water, breaking water column into pieces by the decorative cover, and recycling water, to form the fountain. Since the light hood plays a role of a light shield, the light is projected into the fountain all the time to produce the effect of lighting fountain. Therefore, the lighting fountain can be integrated into a small-sized lamp, which has the effect that it is portable, and can be flexibly transferred to various sites where the available space is limited.

2. The spherical surface and the light-collecting hood can focus the light into the water column to be sprayed out. The light-shielding hood can shield the superfluous stray light, such that the light at the opening of the water storage chamber is entirely concentrated in the sprayed fountain, thereby obtaining a better lighting effect.

3. After shunting by the shunt disc, the fountain is not limited to the middle part or some other location but a plurality of collaborative locations, thereby forming the fountain with a plurality of sprayed water columns.

4.Via the dual functionality of the water-shielding plate and the filter plate, the impurities can be trapped to protect the pump, and the water can also be trapped to avoid water from spilling out due to an accidental flip.

5. It is designed to have the interior part and the exterior part having transparent and opaque characteristics respectively, so as to have a gentle light and clear sight.

DETAILED DESCRIPTION OF THE PREFERRED EMBODIMENTS

The present invention is further illustrated in detail in combination with the accompanying drawings hereinafter.

Figure 1:
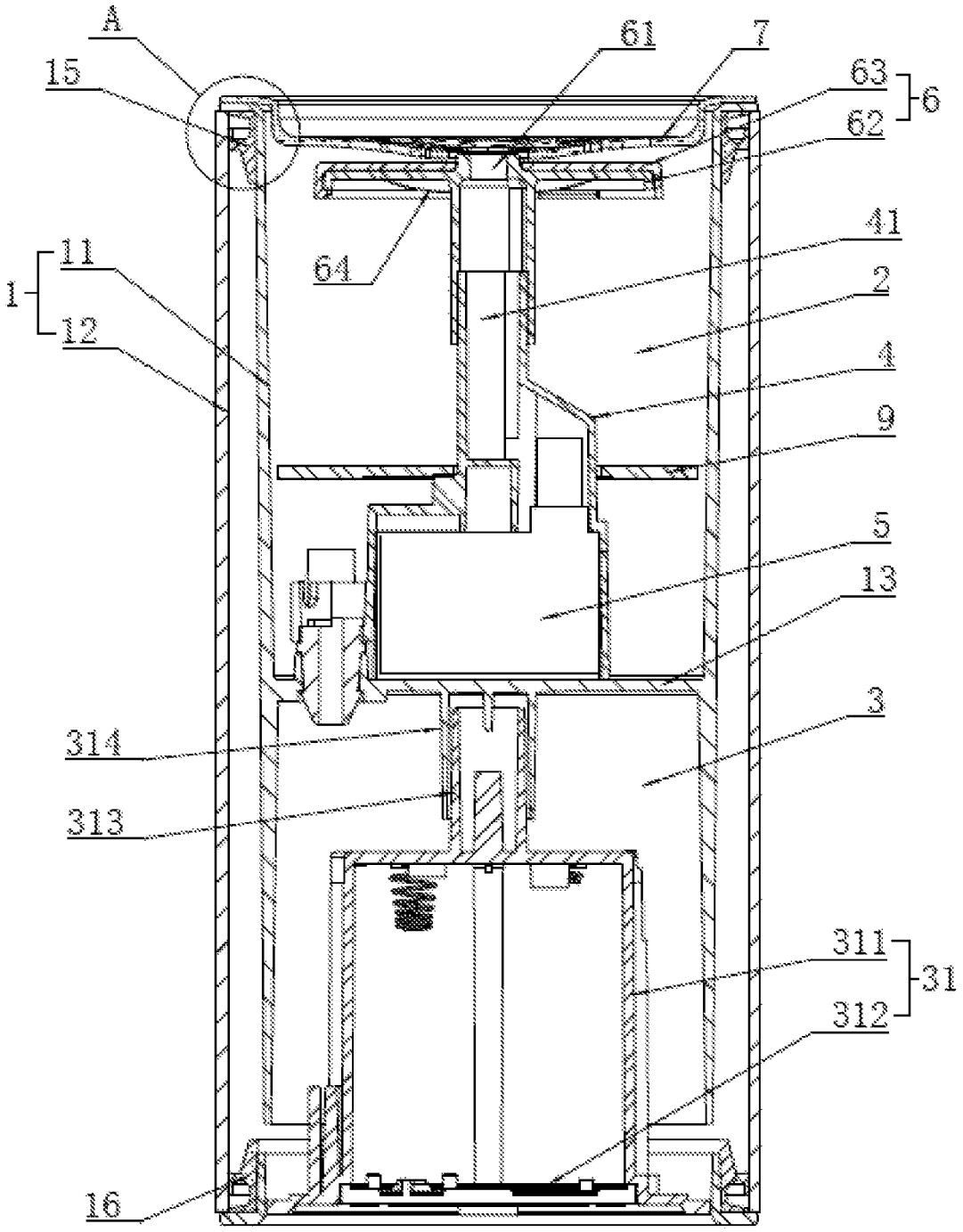
FIG. 1 is a schematic view of the internal structure of the fountain light of embodiment 1.
Figure 2:
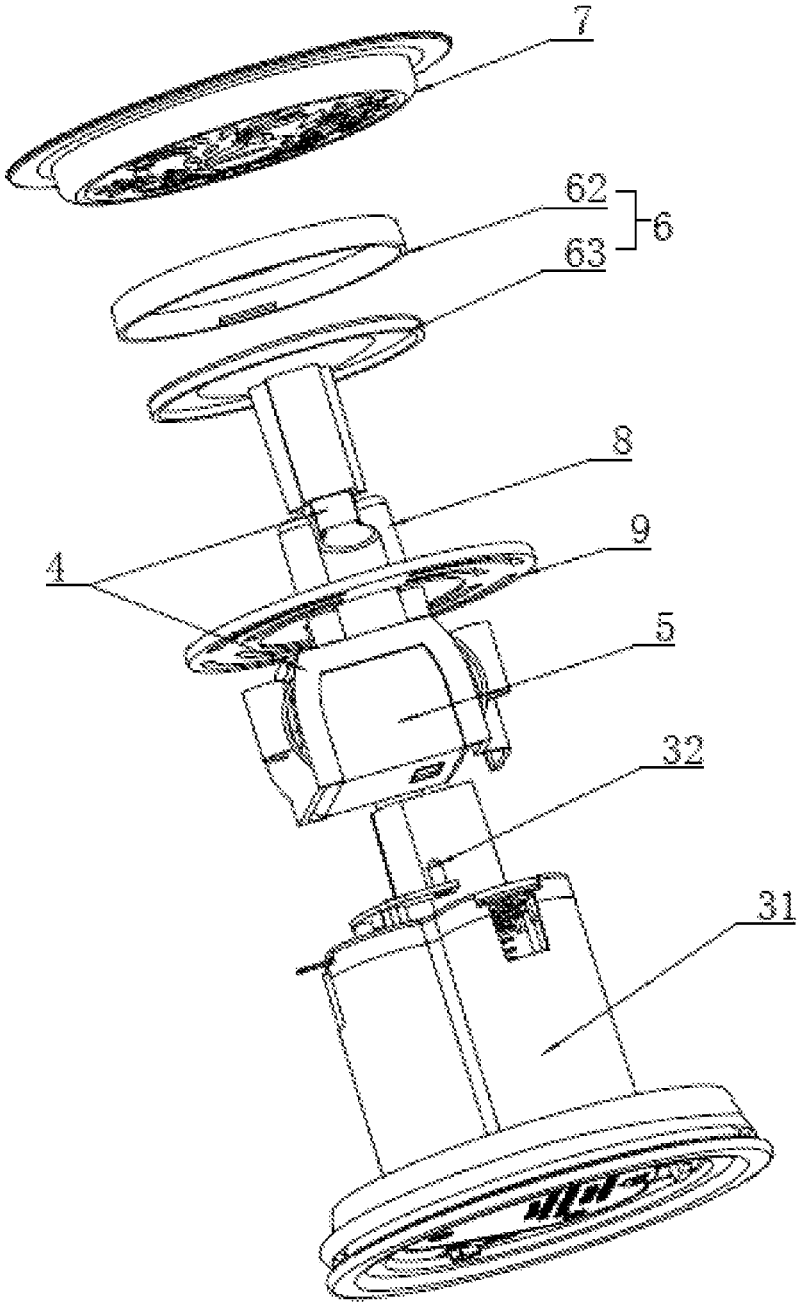
FIG. 2 is an exploded view of the internal structure of the fountain light of embodiment 1.

In embodiment 1, referring to FIGS. 1 and 2, a fountain light disclosed by the present invention comprises a hollow cylindrical light body 1, in which an isolation plate 13 is fixed for dividing the inner chamber of the light body 1 into a water storage chamber 2 and a power supply chamber 3, which are vertically arranged one above the other. The water storage chamber 2 can store water therein, accommodate a light and a fountain forming structure. The power supply 3 contains a power supply 31 and a control chip therein, so as to supply power to members in the water storage chamber 2 and control the light and the fountain to turn on/off.

Figure 3:
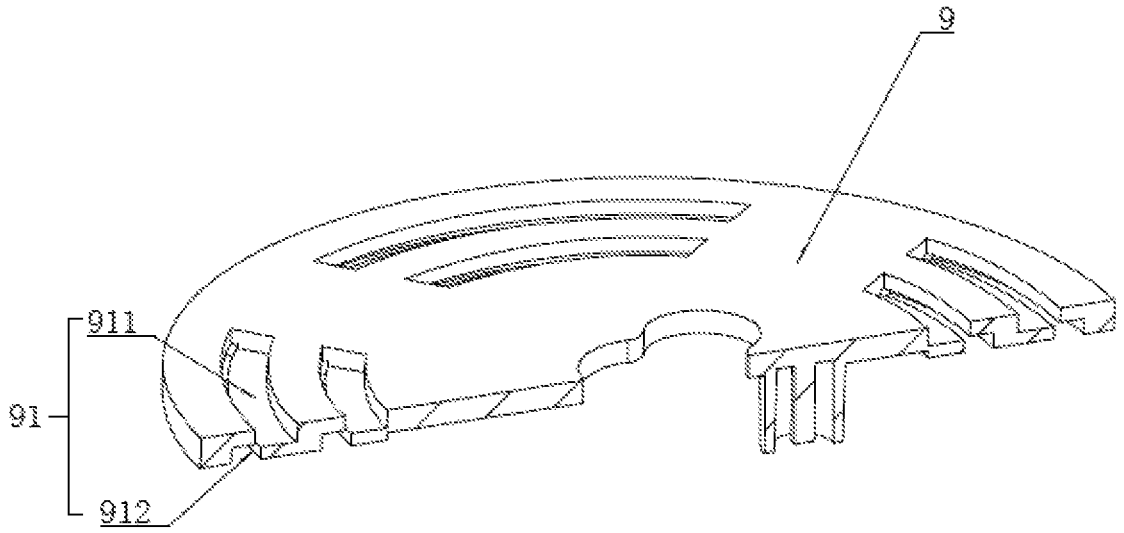
FIG. 3 is a structural view of the filter plate in embodiment 1.

The water storage chamber 2 is provided with a water-passing bracket 4 and a pump 5 at the bottom thereof. The pump 5, which can be a low-voltage DC pump, is mounted in the water-passing bracket 4. The water-passing bracket 4 is provided therein with a water passage 41 communicated with the water outlet of the pump 5. A light permeable light hood 6 is sleeved and fixed at the top of the water-passing bracket 4. A water outlet hole 61 communicated with the water passage 41 is arranged in the center of the light hood 6. A decorative cover 7 is stacked on the top of the light body 1. The central part of the decorative cover 7 is concaved and accommodated in the water storage chamber 2. The concaved part of the decorative cover 7 has a hollowed-out pattern. When the pump 5 operates, the water is sprayed out through the water outlet hole 61 and passes through the hollowed-out pattern of the decorative cover 7, thereby forming a fountain above the concaved part of the decorative cover 7. The light hood 6 is arranged to be spaced apart from the inner wall of the water storage chamber 2. The sprayed-out water falls down through the gap between the light hood 6 and the water storage chamber 2, and returns to the lower part of the water storage chamber 2. During the falling process, the water passes through a filter plate 9 arranged at the middle part of the water storage chamber 2. The bottom of filter plate 9 abuts against the top of a part of the water-passing bracket 4 covering the pump 5, and other parts of the water-passing bracket 4 extend through the central part of the filter plate 9. Referring to FIG. 3, the filter plate 9 is provided a plurality of filtering openings 91 surrounding the water-passing bracket 4. The filtering opening 91 comprises a water inlet groove 911 arranged in the upper surface of the filter plate 9 and a water outlet groove 912 in the lower surface of the filter plate 9. The water inlet groove 911 is offset horizontally relative to and communicated with the water outlet groove 912. The bottom of the water inlet groove 911 is inclined with respect to the upper surface of the filter plate 9. One end of the bottom of the water inlet groove 911 adjacent to the water outlet groove 912 is higher than the other end remote from water outlet groove 912.

Referring to FIG. 2, the light hood 6 comprises a light-collecting hood 62 and a light-shielding hood 63. The light-collecting hood 62 is provided with a spherical surface 64 at the bottom wall thereof. The upper part of the light-collecting hood 62 is snapped into the light-shielding hood 63. Between the light hood 6 and the pump 5, a first light source 8 is fixed on the side wall of the water-passing bracket 4. The first light source 8 extends through the filter plate 9, and emits the light to the surrounding area. The light that is directed to the top is collected through the spherical surface 64 and is projected into the water column in the water outlet hole 61.

Figure 4:
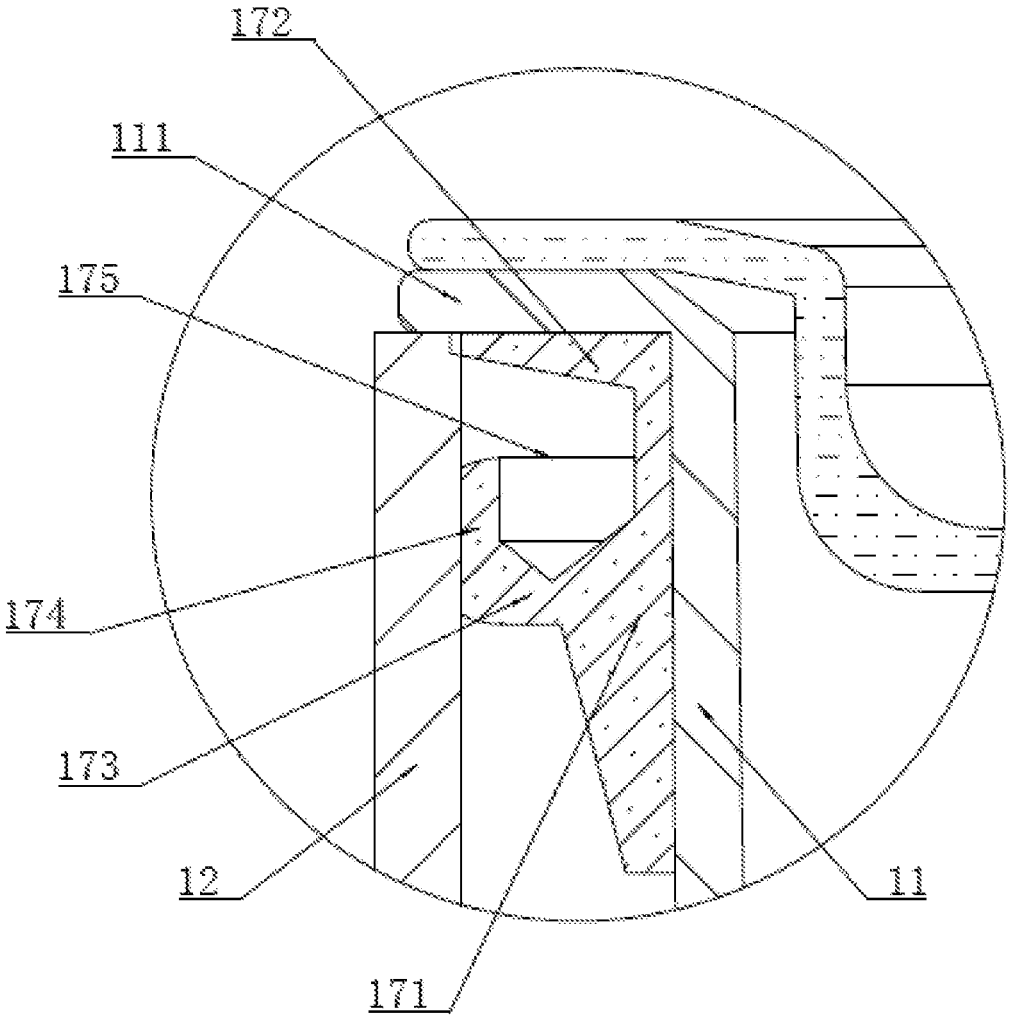
FIG. 4 is an enlarged view of area "A" in FIG. 1 according to embodiment 1.

Referring to FIGS. 1 and 4, the light body 1 comprises an inner cylinder 11 and an outer cylinder 12. The inner cylinder 11 is made of light-permeable plastic, such as translucent PVC plastics in the present embodiment, such that the light becomes more gentle after passing through the inner cylinder 11. The outer cylinder 12 is made of glass. The side wall of the outer cylinder 12 consists of opaque regions and transparent regions. In actual use, the transparent regions can be arranged to have various patterns to provide better decorative effect.

A flange 111 is arranged at the upper end of the inner cylinder 11, which is overlapped on the upper end face of the outer cylinder 12. A first seal ring 15 is arranged between the upper end of the inner cylinder 11 and the upper end of the outer cylinder 12. A lower end cap covering the power supply 31 is lapped on the lower end face of the outer cylinder 12. A second seal ring 16, which fits against the inner wall of the outer cylinder 12, is arranged on the lower end cap. The first seal ring 15 has the same structure as the second seal ring 16, which comprises a seal ring body 171, a horizontal part 172, a connection part 173, and a vertical part 174. The inner wall of the seal ring body 171 abuts against the outer wall of the inner cylinder 11 or the outer wall of the lower end cap. The horizontal part 172 extends horizontally from a start point, i.e. the one end of the seal ring body 171. The connection part 173 extends horizontally from the middle of the side wall of the seal ring body 171. The vertical part 174 extends vertically from a start point, i.e., the horizontal end of the connection part 173 towards the horizontal part 172, and the end of the vertical part 174 is spaced apart from the horizontal part 172. The outer wall of the vertical part 174 and horizontal end of the horizontal part 172 each abut against the inner wall of the outer cylinder 12. The seal ring body 171, the horizontal part 172, the connection part 173 and the vertical part 174 together form a semi-closed glue chamber 175, the opening of which faces the inner wall of the outer cylinder 12.

A second light source 32 is also arranged in the power supply chamber 3. Both the control chip and the second light source 32 are electrically connected with the power supply 31. The control chip controls the pump 5, the first light source 8 and the second light source 32 to turn on and off. The control chip is wirelessly connected with a controller 10.

Figure 5:
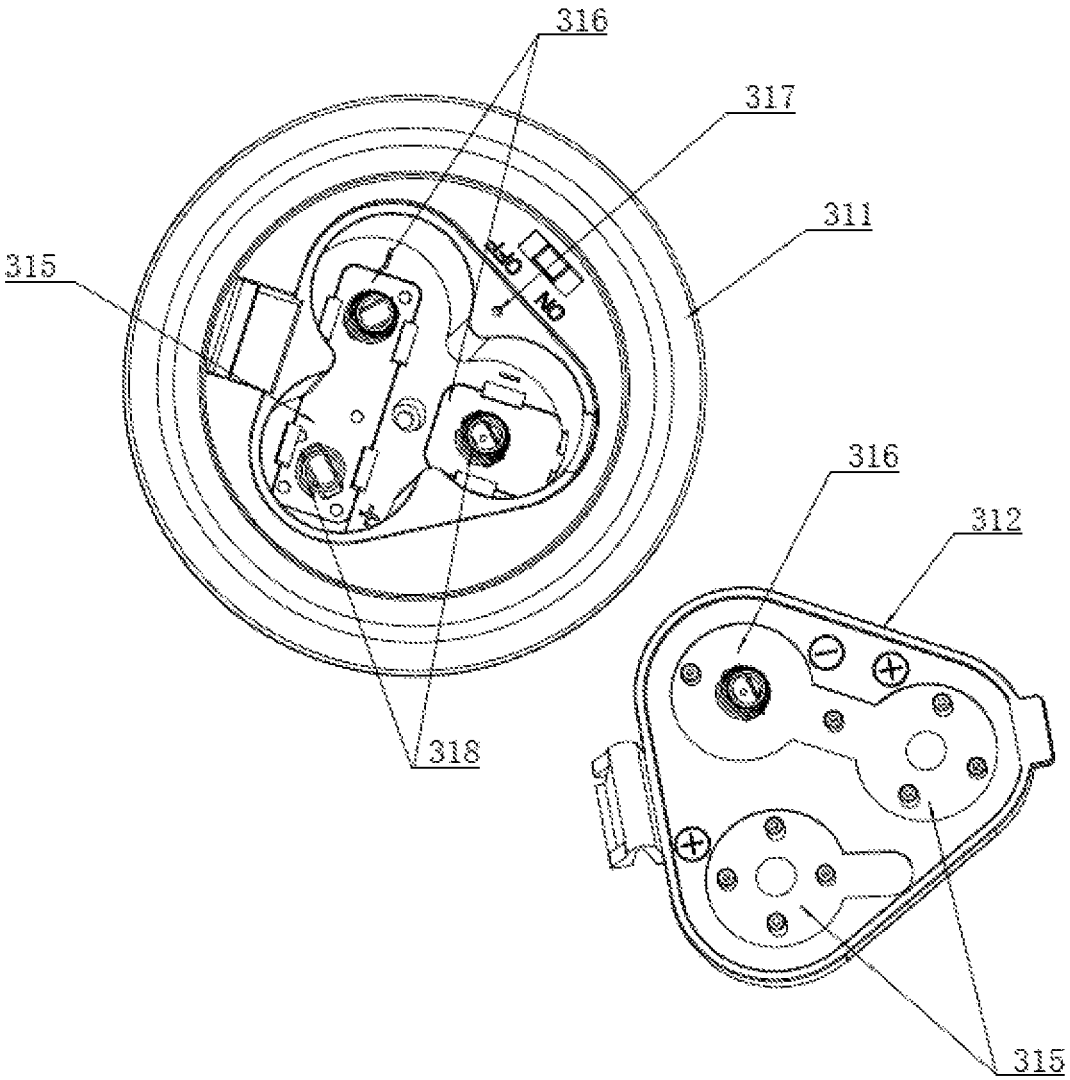
FIG. 5 is a structural view of the battery compartment and the battery compartment cover of embodiment 1.

Referring to FIGS. 1 and 5, the power supply 31 comprises a battery compartment 311, a compartment cover 312 and batteries. The compartment cover 312 is detachably connected to the battery compartment 311. The battery compartment 311 contains three batteries therein. The lower end of the battery compartment 311 is integrally formed with the lower end cap. The battery compartment 311 is provided with a guide post 313. The isolation plate 13 is provided with a locating flange 314 fitted with the guide post 313. The guide post 313, the isolation plate 13, and the water-passing bracket 4 are fixedly connected by threaded connections. Each of the opposing surfaces of the battery compartment 311 and the compartment cover 312 is provided with anode patches 315 connected to the positive electrode of the battery and cathode patches 316 connected to the negative electrode of the battery. The cathode patches 316 and the anode patches 315 in the battery compartment 311 are each provided with a conductive spring 318. The conductive spring of the anode patch 315 is shorter than the conductive spring 318 of the cathode patch 316. A telescopic conductive pin 317, which butts against the single anode patch 315 of the box cap 312, is arranged to penetrate the battery compartment 311.

The operation principle of the present embodiment will be described as below.

First of all, a quantity of water is added into the water storage chamber 2; then, the water in the water storage chamber 2 is drawn by the pump 5 into the interior of the pump through the water inlet of pump, and is sprayed out sequently through the water outlet and the water outlet hole 61, such that the fountain is formed when the water column reaches a position above the decorative cover 7, and at this time, the light emitted from the first light source 8 is collected into the water column in the water outlet hole 61 through the spherical surface 64 of the light-collecting hood 62, and is ejected out of the decorative cover 7 together with the water column; and finally, the water fallen back on the upper wall of the decorative cover 7 returns to the water storage chamber 2 through the hollowed-out holes without sprayed water.

Figure 6:
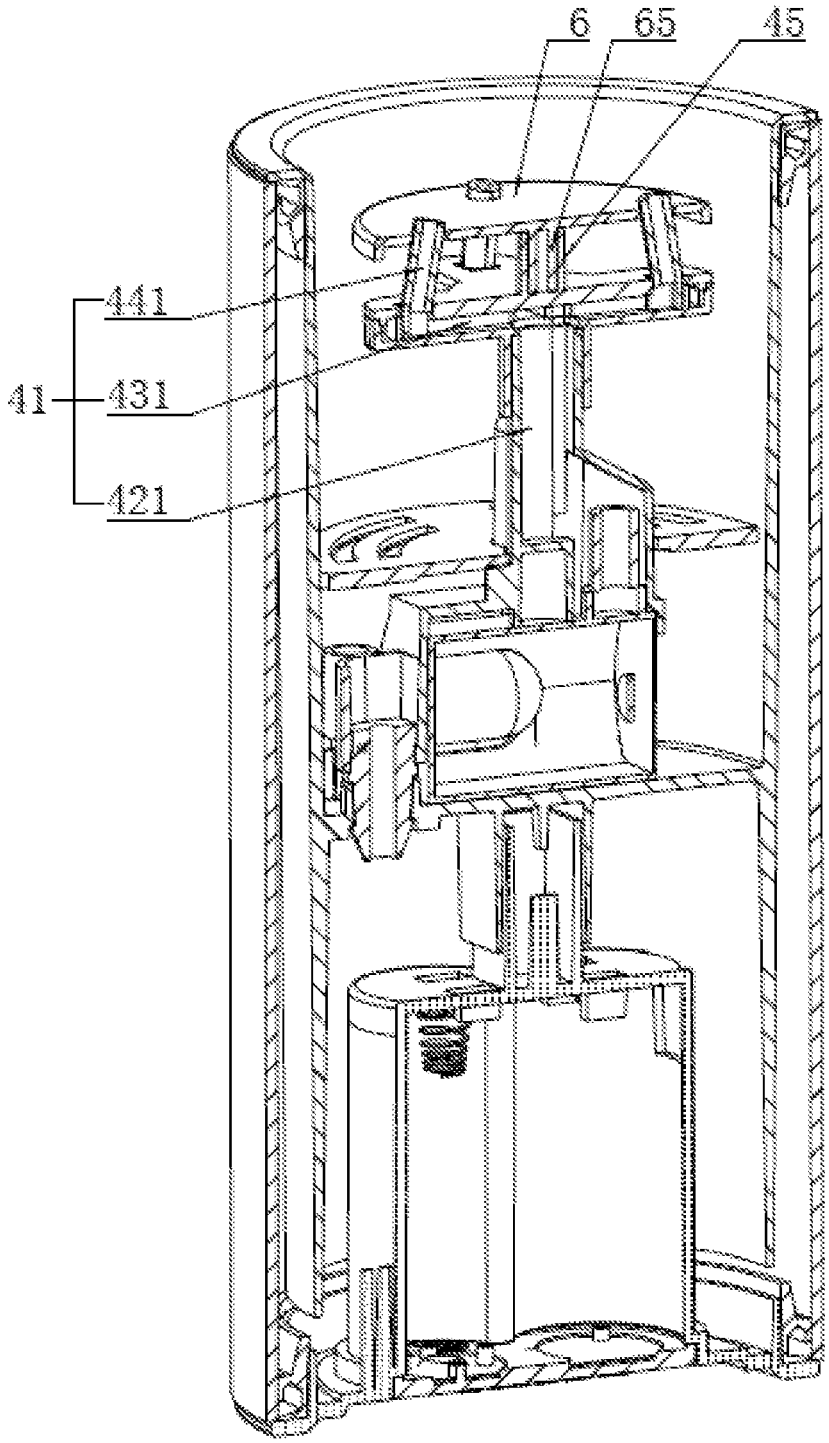
FIG. 6 is a schematic view of the internal structure of the fountain light of embodiment 2.

Regarding embodiment 2, referring to FIG. 6, the differences between embodiments 1 and 2 lie in the following aspects. Four water outlet holes 61 are arranged in the light hood 6. The water-passing bracket 4 comprises a main body 42, a shunt disc 43 and nozzles 44, which are sequentially interconnected from below to above. The nozzle 44 is arranged to communicate with the water outlet hole 61, and the number of the nozzles 44 corresponds to the number of the water outlet holes 61. The nozzles 44 are inclined with respect to the central axis of the inner cavity of the light body 1, and the extension lines of the upper ends of the nozzles 44 converge at the central axis of the light hood 6. The light hood 6 is provided with a supporting tube 65 at the convex part of the bottom thereof. The shunt disc 43 is provided with a supporting base 45 at the convex part of the top thereof for mounting the supporting tube 65.

The water-passing passage 41 comprises a main passage 421, shunt passages 431 and nozzle passages 441, which are arranged in the main body 42, the shunt disc 43 and nozzles 44 respectively. The number of the shunt passages coincides with the number of the nozzle passages 44. The shunt passage 431 communicates with the main passage 421. In operation, the water from the pump 5 is diverted to the shunt passages 431 through the main passage 421, and then is sprayed out through the nozzle passages 441, to form a fountain from outside to inside.

The nozzle 44 comprises a tube and a base which are formed into one piece. The base is a cuboid and arranged in the shunt disc 43. The top surface of the base is flush with the top surface of the shunt disc 43. The two surfaces are collectively covered with seal glue. The nozzles 44 are located below the decorative cover 7, such that the water column is broken into pieces by the hollowed-out pattern when passing through the decorative cover 7.

Figure 7:
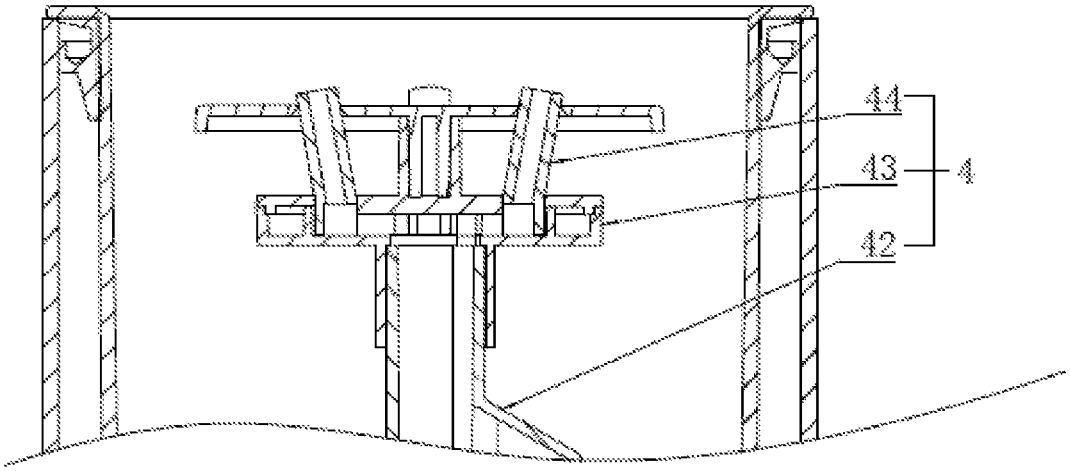
FIG. 7 is a schematic view of the internal structure of the fountain light of embodiment 3.

Regarding embodiment 3, referring to FIG. 7, the difference between embodiments 3 and 2 lies in the following aspect. The extension lines of the lower ends of the nozzles 44 converge at the central axis of the light hood 6.

Regarding embodiment 4, referring to FIG. 8, the differences between embodiments 4 and 2 lie in the following aspects. The inner wall of the water storage wall 2 has an increasing thickness from the opening to the bottom. The water storage chamber 2 is provided with a water-shielding plate 21 arranged below the light hood 6. The water-shielding plate 21 forms an interference fit with or is glued to the inner wall of the water storage chamber 2. The water-shielding plate 21 is located above the filter plate 9.

The water-shielding plate 21 is downwardly recessed around the central part as a center to form a cone, and the central part thereof is arranged to be spaced art from the outer wall of the water-passing bracket 4 to form at least a shutoff groove 211 on the conical surface of the water-shielding plate 21.

During normal use, the water flown down from the light hood 6 is guided by the conical structure of the water-shielding plate. In this process, part of the impurities such as dust contained in the water are trapped by the shutoff grove 211 so as to protect the pump 5. In addition, since the battery compartment is at the bottom, accidental flip may occur. When a user accidentally flips it, the water-shielding plate 21 can serve as a water shield to prevent water from inadvertently flowing out.

Figure 8:
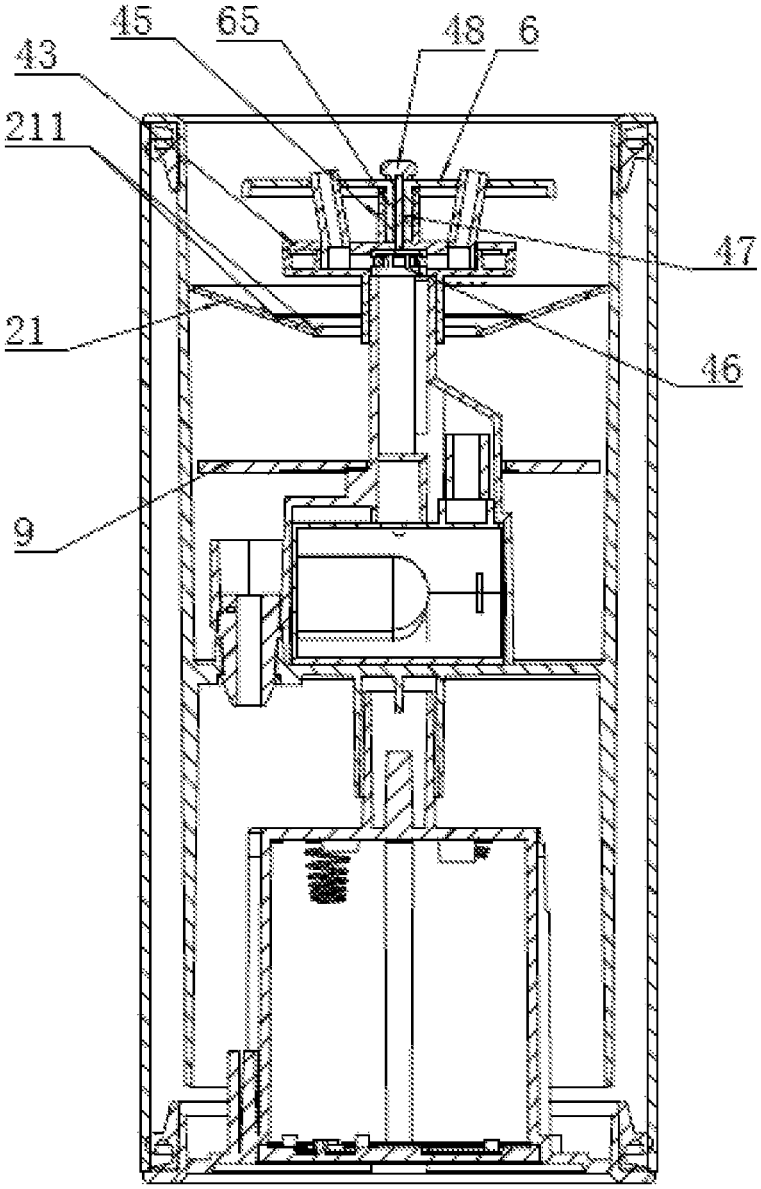
FIG. 8 is a schematic view of the internal structure of the fountain light of embodiment 4.
Figure 9:
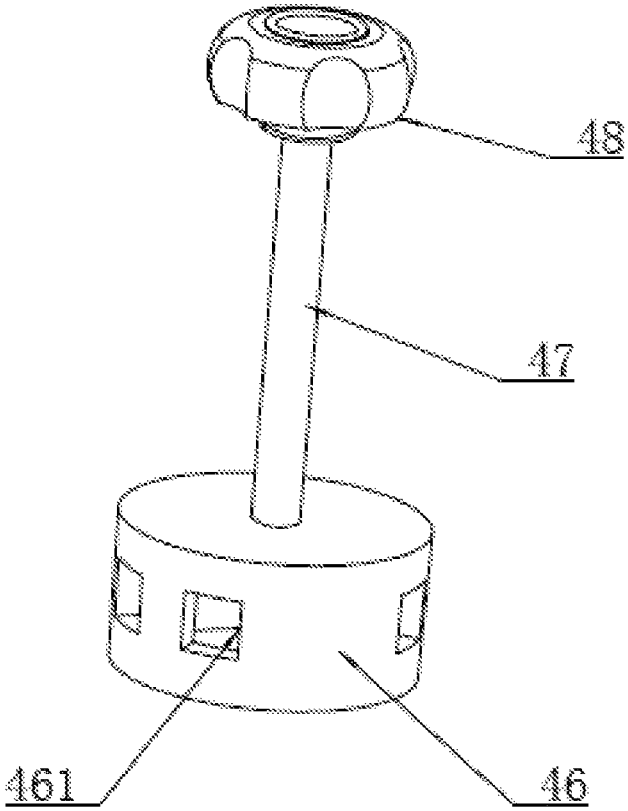
FIG. 9 is a structural view of the adjustment cap of embodiment 4.
Figure 10:
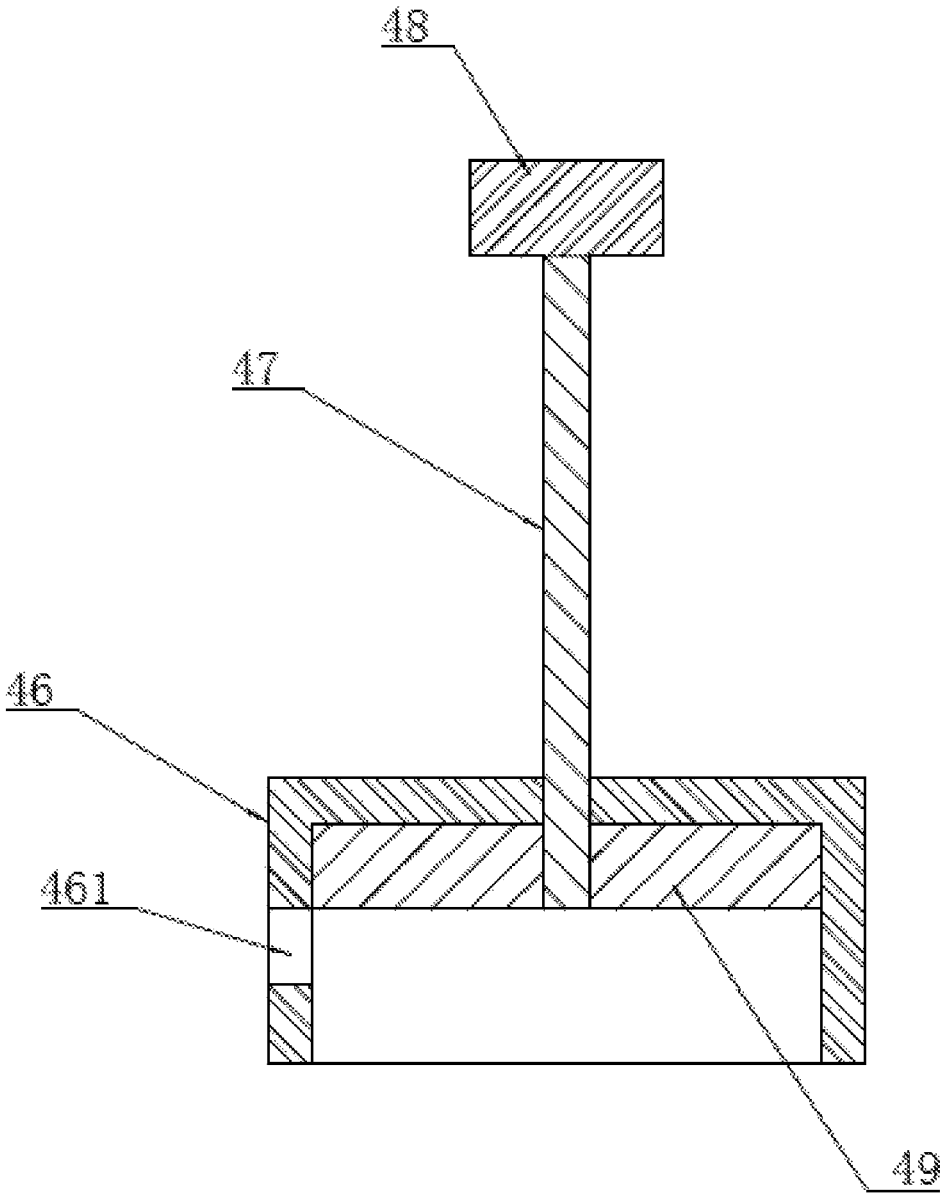
FIG. 10 is a structural view of the adjustment cap of embodiment 5.

Referring to FIGS. 8 and 9, the shunt disc 43 consists of upper and lower members, in which the inner surface of the upper member abuts against the top of the base. An adjustment cap 46 is arranged at the junction of the main passage 421 and the shunt passage 431. An adaptor chamber 461 communicated with the main passage 421 is arranged at bottom of the adjustment cap 46. The sidewall of the adaptor chamber 461 has at least a set of through apertures 462 therein to communicate with the shunt passages 431. The top of the adjustment cap 46 has an adjustment rod 47 fixed thereto, which extends through the shunt disc 43, the inner cavity of the supporting tube 65 and the light hood 6. The top of the adjustment rod 47 has a knob 48 fixed thereto.

Regarding embodiment 5, the differences between embodiments 5 and 4 lie in the following aspects. The adjustment rod 47 is threadedly connected to the adjustment cap 46. The adjustment cap 46 is vertically slidably connected to a piston 49, which is also rotably connected to the adjustment rod 47. The opening size or shutdown of the through aperture 462 can be adjusted by sliding the piston 49 up and down.

Regarding embodiment 6, the differences between embodiments 6 and 1 lie in the following aspects. The sidewall of the concaved part of the decorative cover 7 is provided with a damping layer, which is made of rubber or other materials with good seal ability and damping ability. The outer wall of the damping layer abuts against the inner wall of the inner cylinder 11.

The above description is only preferred embodiments of the present invention and is not intended to limit the protection scope of the present invention. Therefore, all equivalent changes of the structure, shape or principle according to the spirit of the present invention should be all included in the protection scope of the present invention.

The invention claimed is:

1. A fountain light comprising a light body, wherein the light body is provided therein with an isolation plate dividing an inner chamber of the light body into a water storage camber and a power supply chamber, which are vertically arranged one above the other;

wherein the water storage chamber is provided with a pump and a water-passing bracket at a bottom thereof;

wherein the top of the water storage chamber is provided with a light hood connected to a top of the water-passing bracket;

wherein the light hood is arranged to be spaced apart from an inner wall of the water storage chamber;

wherein the light hood is provided with at least one water outlet hole;

wherein the water-passing bracket is provided with a water passage communicated with the water outlet of the pump and the at least one water outlet hole;

wherein a first light source is provided between the light hood and the pump;

wherein the power supply chamber accommodates a power supply that supplies power to the first light source and the pump;

wherein a decorative cover is stacked on a top of the light body;

wherein a central part of the decorative cover is concaved and accommodated in the water storage chamber; and wherein the concaved part of the decorative cover has a hollowed out pattern through which water ejected from the water outlet passes through.

2. The fountain light according to claim 1, wherein the light hood comprises a light-collecting hood and a light-shielding hood;

wherein the light-collecting hood is provided with a spherical surface at a bottom wall thereof; and wherein an upper part of the light-collecting hood is snapped into the light-shielding hood.

3. The fountain light according to claim 1, wherein the at least one water outlet hole comprises at least two water outlet holes, the light hood is provided with the at least two water outlet holes;

wherein the water-passing bracket comprises a main body, a shunt disc and at least one nozzle, which are sequentially interconnected from below to above;

wherein the at least one nozzle is arranged to communicate with the at least one water outlet hole, and a number of the at least one nozzle corresponds to a number of the at least one water outlet hole;

wherein the water-passing passage comprises a main passage, shunt passages and nozzle passages, which are arranged in the main body, the shunt disc and the nozzle respectively;

wherein a number of the shunt passages coincides with a number of the nozzle passages; and wherein the shunt passages communicate with the main passage.

4. The fountain light according to claim 3, wherein the light hood is provided with a supporting tube at a convex part of a bottom thereof;

wherein the shunt disc is provided with a supporting base at a convex part of a top thereof for mounting the supporting tube;

wherein an adjustment cap is arranged at a junction of the main passage and the shunt passage;

wherein an adaptor chamber communicated with the main passage is arranged at a bottom of the adjustment cap;

wherein a sidewall of the adaptor chamber has at least a set of through apertures therein to communicate with the shunt passages;

wherein a top of the adjustment cap has an adjustment rod fixed thereto, which extends through the shunt disc, an inner cavity of the supporting tube and the light hood; and wherein a top of the adjustment rod has a knob fixed thereto.

5. The fountain light according to claim 1, wherein the power supply comprises a battery compartment, a compartment cover and batteries;

wherein the compartment cover is detachably connected to the battery compartment;

wherein the battery compartment contains the batteries therein;

wherein each of opposing surfaces of the battery compartment and the compartment cover is provided with anode patches connected to positive electrodes of the batteries and cathode patches connected to negative electrodes of the batteries;

wherein the cathode patches and the anode patches in the battery compartment are each provided with a conductive spring;

wherein the conductive spring of the anode patch is shorter than the conductive spring of the cathode patch; and wherein a telescopic conductive pin, which butts against the single anode patch of the compartment cover, is arranged to penetrate the battery compartment.

6. The fountain light according to claim 1, wherein the inner wall of the water storage wall has an increasing thickness from an opening to the bottom;

wherein the water storage chamber is provided with a water-shielding plate arranged below the light hood;

wherein the water-shielding plate forms an interference fit with or is glued to the inner wall of the water storage chamber;

wherein the water-shielding plate is downwardly recessed around a central part as a center to form a cone; and wherein the central part is arranged to be spaced art from an outer wall of the water-passing bracket to form at least a shutoff groove on a conical surface of the water-shielding plate.

7. The fountain light according to claim 1, wherein the light body is a hollow cylinder, comprising a translucent inner cylinder and a transparent outer cylinder;

wherein a flange is arranged at an upper end of the inner cylinder, which is overlapped on an end face of the outer cylinder;

wherein a first seal ring is arranged between the upper end of the inner cylinder and the upper end of the outer cylinder;

wherein a lower end cap covering the power supply is lapped on a lower end face of the outer cylinder; and wherein a second seal ring, which fits against an inner wall of the outer cylinder, is arranged on the lower end cap.

8. The fountain light according to claim 7, wherein the first seal ring has a same structure as the second seal ring, which comprises a seal ring body, a horizontal part, a connection part, and a vertical part;

wherein an inner wall of the seal ring body abuts against an outer wall of the inner cylinder or an outer wall of the lower end cap;

wherein the horizontal part extends horizontally from one end of the seal ring body as a start point;

wherein the connection part extends horizontally from a middle of a side wall of the seal ring body;

wherein the vertical part extends vertically from a horizontal end of the connection part as a start point towards the horizontal part, and an end of the vertical part is spaced apart from the horizontal part;

wherein an outer wall of the vertical part and a horizontal end of the horizontal part abut against the inner wall of the outer cylinder; and wherein the seal ring body, the horizontal part, the connection part and the vertical part together form a semi-closed glue chamber, an opening of which faces the inner wall of the outer cylinder.

9. The fountain light according to claim 1, wherein the water storage chamber is provided with a filter plate at a middle, wherein the water-passing bracket is arranged to penetrate a center of the filter plate, wherein the filter plate is provided a plurality of filtering openings surrounding the water-passing bracket;

wherein the filtering opening comprises a water inlet groove arranged in an upper surface of the filter plate and a water outlet groove in a lower surface of the filter plate;

wherein the water inlet groove is offset horizontally relative to and communicated with the water outlet groove;

wherein a bottom of the water inlet groove is inclined with respect to an upper surface of the filter plate; and wherein one end of the bottom of the water inlet groove adjacent to the water outlet groove is higher than the other end remote from water outlet groove.

10. The fountain light according to claim 1, wherein the power supply chamber is provided with a control chip therein;

wherein the control chip is electrically connected to the power supply;

wherein the control chip controls the pump, the first light source, and a second light source arranged in the power supply chamber; and wherein the control chip is wirelessly connected to a controller.

* * * * *